US012650133B2

(12) United States Patent
Yamasaki et al.

(10) Patent No.: US 12,650,133 B2
(45) Date of Patent: Jun. 9, 2026

(54) FAN COMPONENT, FAN, FAN UNIT, AIR CONDITIONER, HEAT PUMP DEVICE, AND METHOD FOR MANUFACTURING FAN COMPONENT

(71) Applicant: DAIKIN INDUSTRIES, LTD., Osaka (JP)

(72) Inventors: Takahiro Yamasaki, Osaka (JP); Hironobu Teraoka, Osaka (JP); Kaname Maruyama, Osaka (JP); Zuozhou Chen, Osaka (JP); Hideaki Konishi, Osaka (JP); Satoshi Nakai, Osaka (JP); Yuki Yamashita, Osaka (JP); Ryusuke Otaguro, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 19/325,260

(22) Filed: Sep. 10, 2025

(65) Prior Publication Data

US 2026/0009405 A1 Jan. 8, 2026

Related U.S. Application Data

(63) Continuation of application No. PCT/JP2024/012925, filed on Mar. 28, 2024.

(30) Foreign Application Priority Data

Mar. 31, 2023 (JP) ..... 2023-059491
Sep. 28, 2023 (JP) ..... 2023-167785

(51) Int. Cl.
*F04D 29/66* (2006.01)
*F04D 19/00* (2006.01)
*F04D 29/02* (2006.01)

(52) U.S. Cl.
CPC ..... *F04D 29/663* (2013.01); *F04D 19/002* (2013.01); *F04D 29/023* (2013.01)

(58) Field of Classification Search
CPC ..... F04D 29/663; F04D 29/66; F04D 29/023; F04D 29/38; F04D 29/02; F04D 19/002; B28C 45/14
See application file for complete search history.

(56) References Cited

U.S. PATENT DOCUMENTS 5,257,902 A * 11/1993 Atarashi ..... F04D 29/023 415/119
11,713,686 B2 * 8/2023 Taylor ..... F01D 5/147 416/223 R (Continued)

FOREIGN PATENT DOCUMENTS

JP 4-12199 A 1/1992
JP H0412199 B2 * 3/1992

(Continued)

OTHER PUBLICATIONS

Kato et al., "Blower and Heat Pump Utilizing said Blower," WO 2010053037, Wipo, May 14, 2010 (Year: 2010).*

(Continued)

*Primary Examiner* — Nathaniel E Wiehe
*Assistant Examiner* — Joshua R Beebe
(74) *Attorney, Agent, or Firm* — Spencer Fane LLP

(57) ABSTRACT

A fan component includes a porous member having multiple pores and a plastic member molded integrally with the porous member. The melt flow rate (MFR) of a plastic forming the plastic member is in a range of 2 g/10 min to 45 g/10 min. Some of the pores are filled with the plastic.

13 Claims, 5 Drawing Sheets

(56) References Cited

U.S. PATENT DOCUMENTS

| | | | | |
|---|---|---|---|---|
| 2017/0089360 | A1* | 3/2017 | Yang | G06F 1/20 |
| 2020/0300327 | A1* | 9/2020 | Oda | F16F 1/3605 |
| 2022/0389939 | A1* | 12/2022 | Hakuta | F04D 19/00 |

FOREIGN PATENT DOCUMENTS

| | | | | |
|---|---|---|---|---|
| JP | 6-25597 | U | | 4/1994 |
| JP | 2005-52234 | A | | 3/2005 |
| JP | 2005052234 | A | * | 3/2005 |
| JP | 2005-155437 | A | | 6/2005 |
| JP | 2021-134751 | A | | 9/2021 |

OTHER PUBLICATIONS

International Search Report of corresponding PCT Application No. PCT/JP2024/012925 dated Jun. 18, 2024.
European Search Report of corresponding EP Application No. 24 74 7970.2 dated May 12, 2025.
Written Opinion of corresponding PCT Application No. PCT/JP2024/012925 dated Jun. 18, 2024.

* cited by examiner

FAN COMPONENT, FAN, FAN UNIT, AIR CONDITIONER, HEAT PUMP DEVICE, AND METHOD FOR MANUFACTURING FAN COMPONENT

CROSS-REFERENCE TO RELATED APPLICATIONS

This application is a continuation of, and claims the benefit of priority from International Application No. PCT/JP2024/012925, filed on Mar. 28, 2024, which claims the benefit of priority from Japanese Patent Application No. 2023-059491, filed on Mar. 31, 2023, and Japanese Patent Application No. 2023-167785, filed on Sep. 28, 2023, the entire contents of each of which are incorporated herein by reference.

BACKGROUND

Technical Field

The present disclosure relates to a fan component, a fan, a fan unit, an air conditioner, a heat pump device, and a method for manufacturing a fan component.

Background Information

To reduce noise of fan units during rotation, porous members are known to be used as fan components. JP2021-134751A discloses a fan including a porous member. As the fan rotates, the pores in the porous member allow airflow to pass from the upper surface to the lower surface of the fan. The fan including the porous member thus reduces noise of the fan unit during rotation.

Also, as a method for manufacturing a fan component including a porous member, a method is known that integrally molds the porous member and a plastic member. For example, JPH04-012199A and JPH06-025597U disclose methods using insert molding that fix a porous member in a mold and inject a plastic into the mold.

SUMMARY

In one general aspect, a fan component includes a porous member having multiple pores and a plastic member molded integrally with the porous member. A plastic forming the plastic member has a melt flow rate (MFR) in a range of 2 g/10 min to 45 g/10 min, and some of the pores are filled with the plastic.

DETAILED DESCRIPTION OF EMBODIMENT(S)

Referring to FIGS. 1 to 9, an air conditioner 10A, a fan unit 20, a fan 30, a fan component 40, and a method for manufacturing the fan component 40 according to an embodiment are now described.

Air Conditioner

Figure 1:
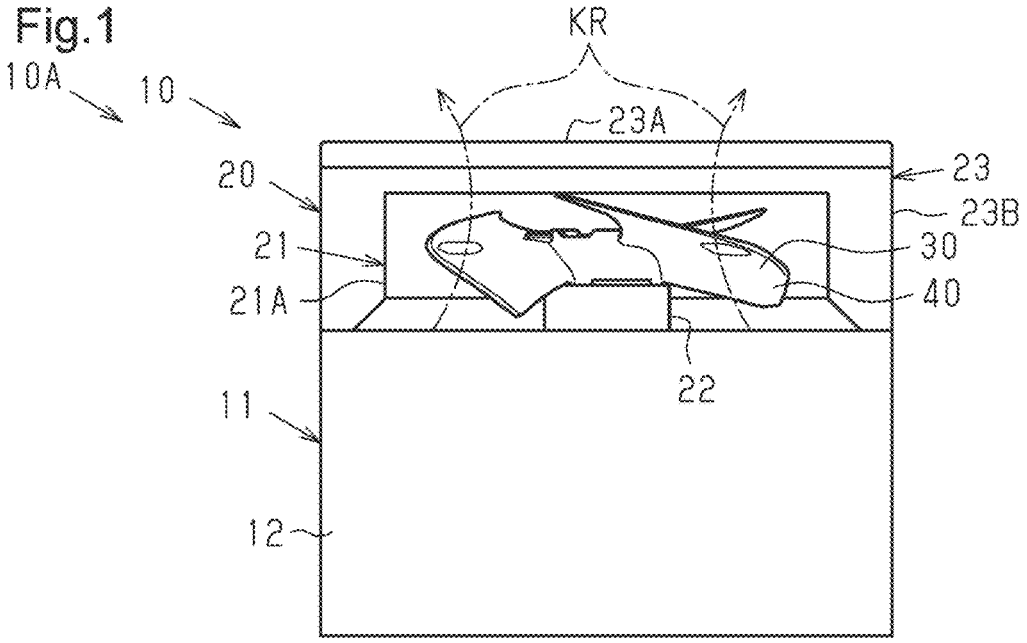
FIG. 1 is a schematic diagram showing the configuration of an outdoor unit.

As shown in FIG. 1, the air conditioner 10A of the present embodiment is an apparatus that adjusts the temperature of indoor air using a vapor compression refrigeration cycle. The air conditioner 10A of the present embodiment includes an outdoor unit 10 and an indoor unit (not shown). The air conditioner is not necessarily limited to an apparatus that adjusts the temperature of indoor air using a vapor compression refrigeration cycle. The air conditioner is a concept that includes an air purifier and a ventilator, for example.

Outdoor Unit

The outdoor unit 10 is the outdoor unit 10 of the air conditioner 10A. The air conditioner 10A cools or heats indoor spaces such as houses and offices. The air conditioner 10A may also cool or heat an indoor space such as a space in a warehouse, where articles are stored, or a work space, where articles are handled.

FIG. 1 is a schematic diagram of the outdoor unit 10 as viewed from the front. In the example of FIG. 1, a vertically-installed outdoor unit 10 is illustrated, but the outdoor unit 10 may be a horizontally-installed unit. The outdoor unit 10 is connected to the indoor unit of the air conditioner 10A by a communication pipe, for example. The indoor unit includes devices such as an indoor expansion valve and an indoor heat exchanger.

The outdoor unit 10 includes a lower unit 11, for example. The lower unit 11 includes a lower casing 12. The lower casing 12 accommodates components of the refrigerant circuit, such as a compressor, an outdoor heat exchanger, an outdoor expansion valve, and an accumulator, and an oil separator, and a control device having electronic components for controlling the refrigerant circuit. The air conditioner 10A includes a fan unit 20. The outdoor unit 10 includes the fan unit 20. The fan unit 20 is connected to the lower unit 11, for example. The indoor unit of the air conditioner 10A may include the fan unit 20.

Fan Unit

The fan unit 20 includes a fan 30 and a bellmouth 21. In this embodiment, the fan 30 is placed so that the central axis of rotation extends in the vertical direction. For example, the fan unit 20 may be configured to blow air drawn in from the lower unit 11 upward through the bellmouth 21 using the fan 30. The bellmouth 21 of the present embodiment is placed so that the airflow KR passes from the lower side to the upper side. The bellmouth 21 has a tubular portion 21A provided around the fan 30. The tubular portion 21A may be made of plastic, for example.

The fan unit 20 may include a motor 22 and a fan casing 23, for example. The rotation shaft of the motor 22 is connected to the fan 30 to rotate the fan 30. The motor 22 may be housed in a motor case, for example.

The fan casing 23 may be placed above the lower casing 12, for example. The fan casing 23 may house the fan 30, the bellmouth 21, and the motor 22, for example. The fan casing 23 may include an air outlet 23A, through which the air blown out from the bellmouth 21 passes, and a support portion 23B, which supports the air outlet 23A. The fan casing 23 may be made of plastic, for example.

Fan

Figure 2:
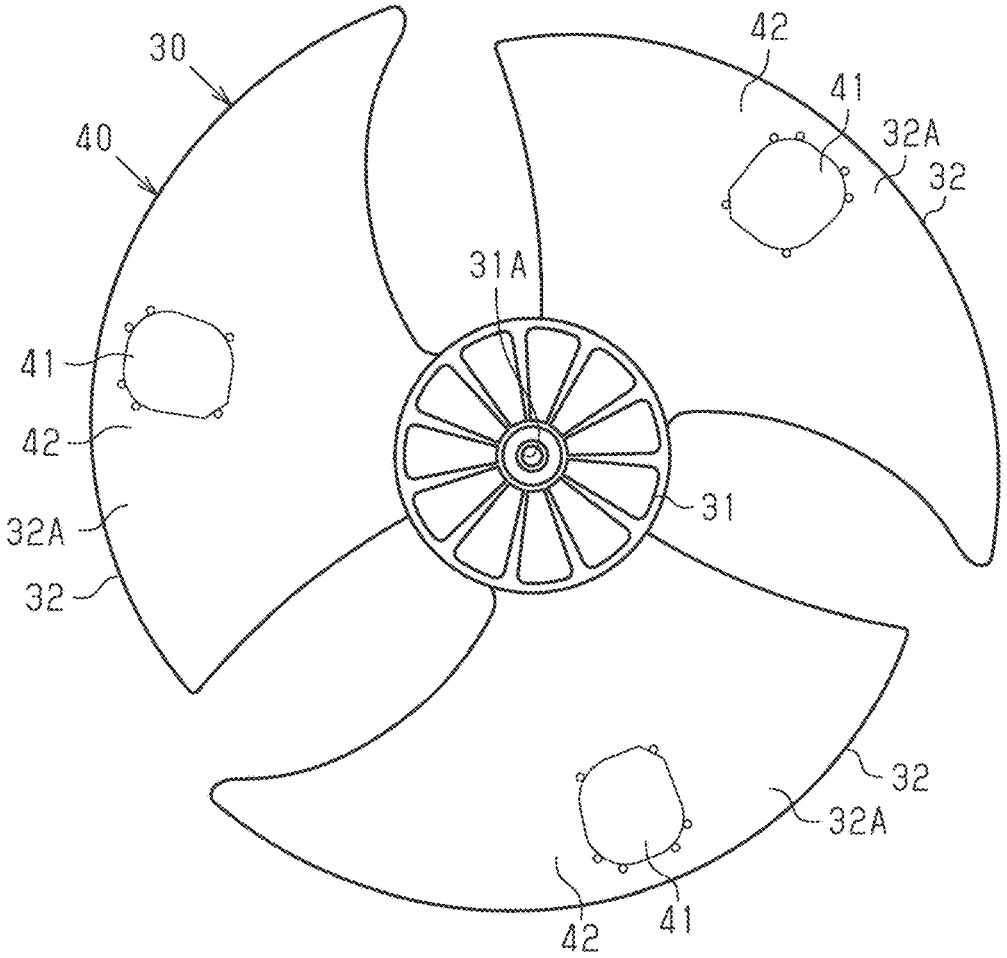
FIG. 2 is a front view of a fan.

As shown in FIG. 2, the fan 30 of the present embodiment is an axial fan. The fan 30 may also be a centrifugal fan. The fan 30 includes a hub 31 and blades 32 arranged around the hub 31. The hub 31 is formed in a cylindrical shape. The hub 31 is formed integrally with the blades 32. The hub 31 has a shaft hole 31A, to which the rotation shaft of the motor 22 is attached.

The blades 32 are arranged on the hub 31 at regular angular intervals in the circumferential direction. In this embodiment, the number of the blades 32 is three, but the number of the blades 32 may be less than three or more than three. The blades 32 are arranged to extend radially outward from the hub 31 in the radial direction of rotation of the fan 30. Adjacent blades 32 do not overlap when the fan 30 is viewed from the front or rear. Each blade 32 is formed in a plate shape that is smoothly curved in the radial direction of rotation and the rotation direction. The blades 32 have the same shape.

Fan Component

As shown in FIGS. 1 and 2, the fan unit 20 includes a fan component 40. The fan component 40 is arranged in the fan unit 20 so as to reduce noise generated in the fan unit 20 by coming into contact with the airflow KR. The member of the fan unit 20 that comes into contact with the airflow KR is formed by the fan component 40, for example. In this embodiment, the fan 30 is formed by the fan component 40.

The fan component 40 includes porous member 41 and plastic member 42. The plastic member 42 is molded integrally with the corresponding porous member 41. The fan component 40 is formed by the plastic members 42. In this embodiment, each blade 32 is formed by a porous member 41 and a plastic member 42. The porous member 41 may be located on the blade surface 32A of each blade 32, for example. The blade surface 32A may be placed so as to face the airflow KR, for example. The thickness of the porous member 41 is substantially the same as the thickness of the plastic member 42. The location where the porous member 41 is placed is not limited to the blade 32. The hub 31 may be configured to include porous members 41.

The fan component 40 is formed by insert molding with each porous member 41 placed in the corresponding plastic 42A (see FIG. 6), which forms the plastic member 42. Each porous member 41 may be formed by a porous body, for example. Examples of materials for forming the porous members 41 include plastic, ceramics, and metal. An example of plastic is a plastic foam. Specific examples of the plastic porous members 41 include a foam made of polystyrene plastic (PS), a foam made of ABS plastic, a foam made of acrylic styrene (AS), and a foam made of polypropylene (PP). The porous members 41 may be made of a glass fiber reinforced styrene acrylonitrile plastic (ASG) foam. The porous members 41 may be porous sintered bodies made of ceramics or metal. The porous members 41 may be metal mesh bodies.

Each porous member 41 has pores. Some of the pores are filled with the plastic 42A. The porous member 41 has a porous structure. The porous structure has through-holes extending through the blade 32 in the thickness direction. Each through-hole of the porous structure is formed by interconnected pores in the porous member 41 and thus extending through the blade 32 in the thickness direction. Airflow KR can pass through pores. The airflow KR passes through pores of the porous members 41, thereby reducing noise generated by the fan unit 20.

Each plastic member 42 may be configured so as to prevent passing of airflow KR, for example. The plastic member 42 may be made of a plastic 42A, for example. The plastic member 42 may be made of a thermoplastic, for example. The plastic member 42 may be made of polystyrene plastic, ABS plastic, glass fiber reinforced styrene acrylonitrile plastic (ASG), or glass fiber reinforced polypropylene plastic (PPGF), for example.

The porous members 41 may be made of the same type of plastic as the plastic members 42. When the porous members 41 are foam bodies made of polystyrene plastic, the plastic members 42 may be made of polystyrene plastic. When the porous members 41 are foam bodies made of ABS plastic, the plastic members 42 may be made of ABS plastic. When the porous members 41 are foam bodies made of acrylic styrene, the plastic members 42 may be made of glass fiber reinforced styrene acrylonitrile plastic. When the porous members 41 are foam bodies made of polypropylene, the plastic members 42 may be made of glass fiber reinforced polypropylene plastic. The porous members 41 may be made of a plastic different from that of the plastic members 42, or may be made of a material different from plastic.

The porous members 41 and the plastic members 42 that are made of the same type of plastic facilitate adherence between the porous members 41 and the plastic members 42 when the plastic members 42 enter the pores in the porous members 41 during insert molding of the fan component 40. The adhesion between the porous members 41 and the plastic members 42 improves the bonding strength between the porous members 41 and the plastic members 42 during insert molding.

Figure 3:
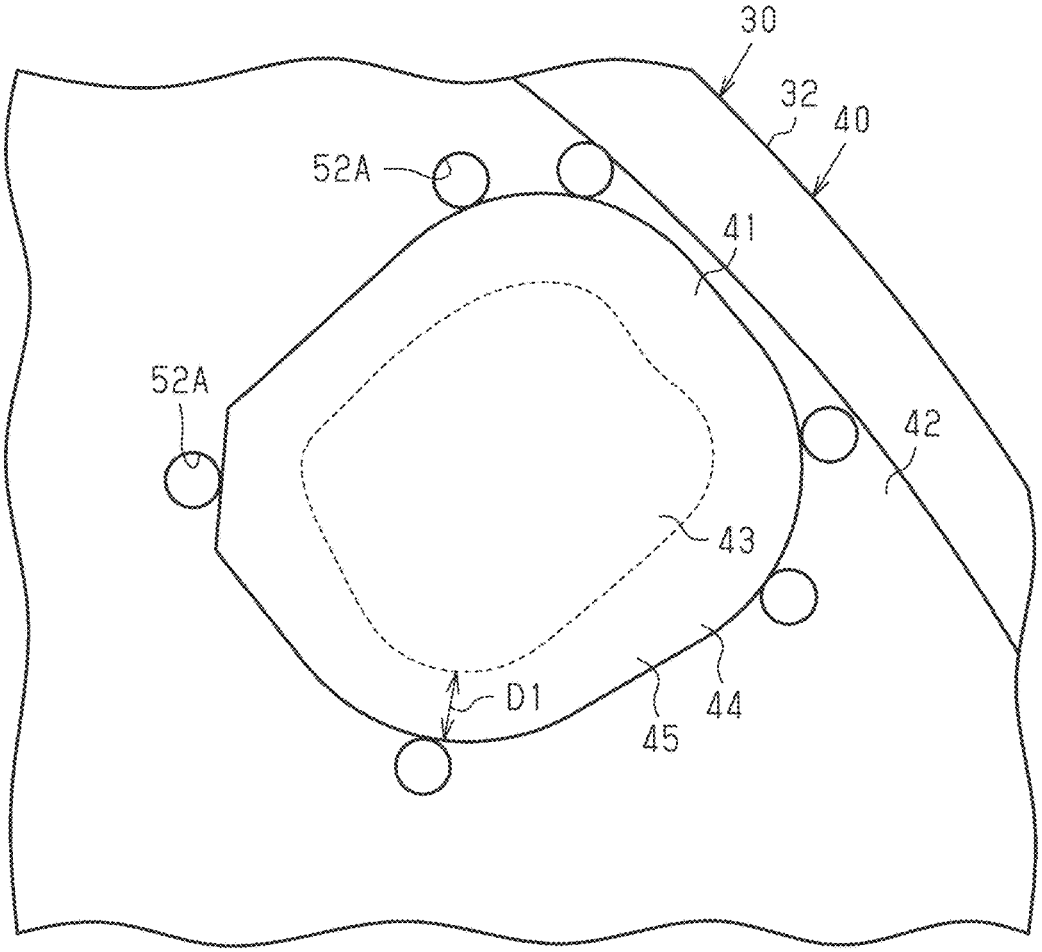
FIG. 3 is an enlarged view of a blade of the fan.
Figure 6:
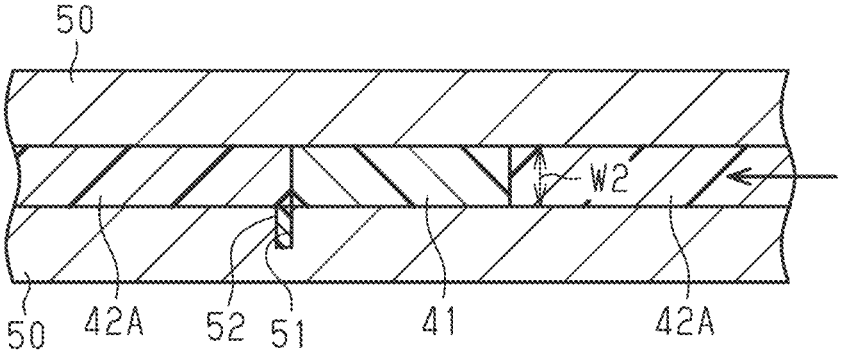
FIG. 6 is a schematic diagram showing a step of the method for manufacturing a fan component.

Referring to FIGS. 3 and 6, the parameters indicating the ease with which the plastic 42A can flow through the porous member 41 may include the melt flow rate (MFR) of the plastic 42A, for example, under predetermined conditions. For example, the higher the MFR, the more easily the plastic 42A flows into the porous member 41 during insert molding. The MFR may be a melt mass-flow rate, for example. The predetermined conditions may be test conditions that conform to ISO 1133, for example. In one example, when the plastic member 42 is made of polystyrene plastic, the predetermined conditions for measuring the MFR of the plastic 42A include a temperature of 200° C. and a load of 5 kg, in accordance with ISO 1133.

Under the predetermined conditions, the MFR of the plastic 42A forming the plastic member 42 is in a range of 2 g/10 min to 45 g/10 min. Under the predetermined conditions, the MFR of the plastic 42A may be in a range of 2 g/10 min to 40 g/10 min. Under the predetermined conditions, the MFR of the plastic 42A may be in a range of 2 g/10 min to 35 g/10 min. Under the predetermined conditions, the MFR of the plastic 42A may be in a range of 2 g/10 min and 30 g/10 min. Under the predetermined conditions, the MFR of the plastic 42A may be in a range of 5 g/10 min to 45 g/10 min. Under the predetermined conditions, the MFR of the plastic 42A may be in a range of 5 g/10 min to 40 g/10 min. Under the predetermined conditions, the MFR of the plastic 42A may be in a range of 5 g/10 min to 35 g/10 min. Under the predetermined conditions, the MFR of the plastic 42A may be in a range of 5 g/10 min to 25 g/10 min. Under the predetermined conditions, the MFR of the plastic 42A may be in a range of 7 g/10 min to 16.5 g/10 min. Under the predetermined conditions, the MFR of plastic 42A may be 7 g/10 min. Under the predetermined conditions, the MFR of plastic 42A may be 16.5 g/10 min. In one example, when the plastic 42A is polystyrene plastic, the predetermined conditions for measuring the MFR of the plastic 42A include a temperature of 200° C. and a load of 5 kg, in accordance with ISO 1133. When the MFR of the plastic 42A is in a range of 2 g/10 min to 45 g/10 min, the plastic 42A does not easily flow into the porous member 41.

The parameters indicating the ease with which the plastic 42A flows through the porous member 41 may include the flow resistance of the porous member 41. For example, when the porous member 41 has a greater flow resistance, the plastic 42A does not easily flow into the porous member 41 during insert molding. The flow resistance of the porous member 41 may be adjusted during the formation of the porous member 41, for example. The flow resistance of the porous member 41 may be adjusted by the pulverized particle size of the material of the porous member 41, for example.

In the embodiment, the flow resistance of the porous member 41 indicates how difficult it is for air to flow through the porous structure of the porous member 41. For example, when the porous member 41 has a greater flow resistance, it is more difficult for the airflow KR to pass through the porous member 41. The porous member 41 having a high flow resistance tends to have a small pore diameter or a low porosity, so that the plastic 42A does not easily flow into the porous member 41.

Figure 4:
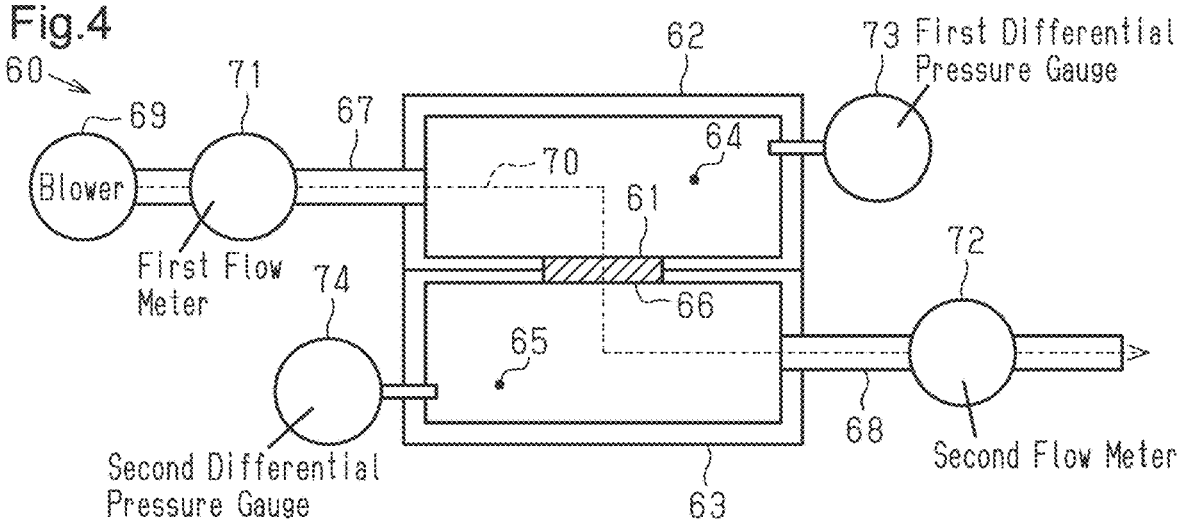
FIG. 4 is a schematic diagram showing a flow resistance measurement device.

FIG. 4 shows an example of a measurement device 60 for measuring the flow resistance of the porous member 41. The measurement device 60 is a tool for measuring the flow resistance of a test piece 61. The measurement device 60 includes a first case 62 and a second case 63. The first case 62 defines a first chamber 64. The second case 63 defines a second chamber 65. The first and second chambers 64 and 65 are connected to each other via a connecting hole 66. The connecting hole 66 extends through the first and second cases 62 and 63. A test piece 61 is placed in the connecting hole 66. The test piece 61 has a porous structure having through-holes extending from the first chamber 64 to the second chamber 65. Air can move between the first chamber 64 and the second chamber 65 by passing through the porous structure of the test piece 61.

The measurement device 60 includes a first flow passage 67, a second flow passage 68, and a blower 69. The first flow passage 67 is connected to the first chamber 64 so as to connect the first chamber 64 to the outside of the first case 62. The second flow passage 68 is connected to the second chamber 65 so as to connect the second chamber 65 to the outside of the second case 63. The first flow passage 67, the first chamber 64, the second chamber 65, and the second flow passage 68 form an airflow passage 70 in the measurement device 60. The blower 69 blows air through the first flow passage 67 into the measurement device 60. The air blown by the blower 69 flows through the airflow passage 70. The air that has flowed through the airflow passage 70 flows out of the measurement device 60 through the second flow passage 68.

The measurement device 60 includes a first flow meter 71 and a second flow meter 72. The first and second flow meters 71 and 72 may be air flow meters, for example. The first flow meter 71 is configured to measure the amount of air passing through the first flow passage 67. The second flow meter 72 is configured to measure the amount of air passing through the second flow passage 68.

The measurement device 60 includes a first differential pressure gauge 73 and a second differential pressure gauge 74. The first and second differential pressure gauges 73 and 74 may be pressure gauges, for example. The first differential pressure gauge 73 is configured to measure the pressure within the first chamber 64. The second differential pressure gauge 74 is configured to measure the pressure within the second chamber 65. The flow resistance of the test piece 61 is the difference between the pressure in the first chamber 64 and the pressure in the second chamber 65 in a state in which air is blown into the measurement device 60 by the blower 69.

The measurement device 60 is configured such that, in a situation where the amount of air passing through the first flow passage 67 is 100 L/min, the difference between the amount of air passing through the first flow passage 67 and the amount of air passing through the second flow passage 68 is less than 1% of the amount of air passing through the first flow passage 67. The first and second cases 62 and 63 are configured so that air cannot move between the first chamber 64 and the second chamber 65 through any portion other than the connecting hole 66. The test piece 61 is placed so as to be interposed between the first and second cases 62 and 63. At this time, the section at which the first case 62 is in contact with the test piece 61 and the section at which the second case 63 is in contact with the test piece 61 are sealed by gaskets to prevent air leakage. The air passage area of the surface of the test piece 61 is set to be the same regardless of the type of the test piece 61. The area of the test piece 61 exposed to the first chamber 64 is set to be the same regardless of the type of the test piece 61. The area of the test piece 61 exposed to the second chamber 65 is set to be the same regardless of the type of the test piece 61. The blower 69 is configured to ensure 100 L/min regardless of any pressure loss caused by the measurement device 60 and the test piece 61 so that the amounts of passing air measured by the first and second flow meters 71 and 72 are stable.

The flow resistance of the porous member 41 is in a range of 0.2 kPa to 1.2 kPa, for example. The flow resistance of the porous member 41 may be in a range of 0.3 kPa to 1.1 kPa, for example. The flow resistance of the porous member 41 may be in a range of 0.35 kPa to 1.0 kPa, for example. When the flow resistance of the porous member 41 is greater than or equal to 0.2 kPa, the plastic 42A does not easily flow into the porous member 41. When the flow resistance of the porous member 41 is less than or equal to 1.2 kPa, pores of the porous member 41 are moderately filled with the plastic 42A, enabling the bonding between the plastic member 42 and the porous member 41.

The flow resistance of the porous member 41 may be in a range of 0.4 kPa to 1.1 kPa, for example. The flow resistance of the porous member 41 may be in a range of 0.5 kPa to 1.1 kPa, for example. The porous member 41 having a flow resistance greater than or equal to 0.4 kPa maintains its porous structure in the fan component 40 in a suitable manner. When the porous member 41 has a flow resistance less than or equal to 1.1 kPa, the plastic member 42 and the porous member 41 are bonded in a suitable manner while maintaining the porous structure of the porous member 41.

The flow resistance of the porous member 41 is greater than the value obtained by multiplying the MFR of the plastic 42A by the gravitational acceleration and then dividing the multiplied value by the cross-sectional area of the porous member 41, for example. The cross-sectional area of the porous member 41 is the cross-sectional area of the porous member 41 when the blade 32 is viewed in the thickness direction.

The flow resistance of the porous member 41 is determined by the pore diameter of the porous member 41 and porosity of the porous member 41. A smaller pore diameter of the porous member 41 increases the flow resistance of the porous member 41, and a larger pore diameter of the porous member 41 reduces the flow resistance of the porous member 41. A lower porosity of the porous member 41 increases the flow resistance of the porous member 41, and a higher porosity of the porous member 41 reduces the flow resistance of the porous member 41.

The pore diameter of the porous member 41 is the average pore diameter of the pores of the porous member 41, for example. There is no limitation on the method for measuring the average pore diameter. For example, it may be measured by a gas adsorption method also known as the BET method. The conditions for the gas adsorption method may be test conditions that conform to JIS Z8831-2 2010 or ISO 15901-2 2006, for example. The conditions for the gas adsorption method may also be test conditions conforming to JIS Z8830 2013 or ISO 9277 2010. The porosity of the porous member 41 may be the total volume of the pores in the porous member 41 with respect to the total volume of the porous member 41.

The porosity of the porous member 41 is in a range of 20% to 90%, and the pore diameter of the porous member 41 is in a range of 50 μm to 500 μm. The porosity of the porous member 41 may also be in a range of 30% to 90%, and the pore diameter of the porous member 41 may be in a range of 90 μm to 300 μm. The porosity of the porous member 41 may also be in a range of 30% to 80%, and the pore diameter of the porous member 41 may be in a range of 100 μm to 200 μm.

As shown in FIG. 3, the porous member 41 has a central portion 43 and a peripheral portion 44. In FIG. 3, the boundary between the central portion 43 and the peripheral portion 44 is indicated by a broken line. The central portion 43 is a portion of the porous member 41 to which the plastic 42A does not flow and the porous structure is exposed. In the central portion 43, the pores of the porous member 41 are maintained so that pores of the porous member 41 form through-holes in the porous member 41 after the insert molding of the fan component 40.

The area of the central portion 43 is in a range of 2400 $mm^2$ to 6200 $mm^2$, for example. The area of the central portion 43 may be in a range of 2800 $mm^2$ to 5800 $mm^2$, for example. The area of the central portion 43 may be in a range of 3200 $mm^2$ to 5400 $mm^2$, for example. The area of the central portion 43 is the area of the central portion 43 of the porous member 41 provided in one blade 32, for example.

The peripheral portion 44 is located around the central portion 43, for example. The peripheral portion 44 is a portion of the porous member 41 to which the plastic 42A flows. After the insert molding of the fan component 40, the pores in the peripheral portion 44 of the porous member 41 may be maintained, but they do not need to be maintained. The width D1 of the peripheral portion 44 is in a range of 2 mm to 6 mm, for example. The width D1 of the peripheral portion 44 is in a range of 2.5 mm to 5.5 mm, for example. The width D1 of the peripheral portion 44 is in a range of 3 mm to 5 mm, for example. The width D1 of the peripheral portion 44 is the length from the edge of the central portion 43 to the edge of the porous member 41, for example. The width D1 of the peripheral portion 44 is the shortest length among the lengths from the edge of the central portion 43 to the edge of the porous member 41, for example.

The pore diameter of the peripheral portion 44 may be the same as the pore diameter of the central portion 43, or may be smaller than the pore diameter of the central portion 43. The porosity of the peripheral portion 44 may be the same as the porosity of the central portion 43, or may be less than the porosity of the central portion 43. In this embodiment, when the pore diameter of the peripheral portion 44 is the same as the pore diameter of the central portion 43, the porosity of the peripheral portion 44 is less than the porosity of the central portion 43. In this embodiment, when the porosity of the peripheral portion 44 is the same as the porosity of the central portion 43, the pore diameter of the peripheral portion 44 is smaller than the pore diameter of the central portion 43.

The flow resistance of the peripheral portion 44 differs from the flow resistance of the central portion 43. In this embodiment, the flow resistance of the peripheral portion 44 is greater than the flow resistance of the central portion 43. The flow resistance of the peripheral portion 44 is set to be different from the flow resistance of the central portion 43 when the porous member 41 is formed. Since the flow resistance of the peripheral portion 44 is greater than the flow resistance of the central portion 43, the plastic 42A is less likely to flow to the central portion 43 beyond the peripheral portion 44 during insert molding of the fan component 40. A flow resistance of the peripheral portion 44 that is greater than the flow resistance of the central portion 43 may result from the porosity being reduced when the mold 50 compresses the porous member 41 and thus compresses the pores during insert molding (see FIG. 6).

As shown in FIG. 3, the porous member 41 includes a filled-pore portion 45. The pores in the filled-pore portion 45 of the porous member 41 are filled with the plastic 42A. The filled-pore portion 45 is a portion that is formed when the plastic 42A enters pores in the porous member 41 during the insert molding of the fan component 40. The filled-pore portion 45 connects the porous member 41 with the plastic member 42. The filled-pore portion 45 is located around the central portion 43. The filled-pore portion 45 may overlap the peripheral portion 44.

Method for Manufacturing Fan Component

Figure 5:
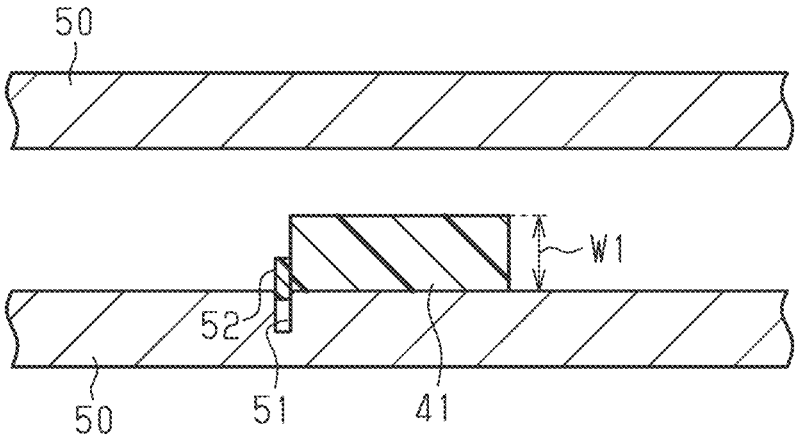
FIG. 5 is a schematic diagram showing a step of a method for manufacturing a fan component.

As shown in FIGS. 3 to 6, the manufacturing method is a method for manufacturing a fan component 40 including a porous member 41 having multiple pores and a plastic member 42 molded integrally with the porous member 41. The manufacturing method includes performing insert molding on the porous member 41 with a plastic 42A having a melt flow rate (MFR) in a range of 2 g/10 min to 45 g/10 min. The fan component 40 may be formed by insert molding, for example. In FIGS. 5 and 6, the right side of the figure corresponds to the hub 31 of the blade 32 in the radial direction of rotation. The left side of the figure corresponds to the outer end of the blade 32 in the radial direction of rotation. The manufacturing method includes a first step, a second step, and a third step.

The first step places the porous member 41 in a mold 50. FIG. 5 shows a state in which the porous member 41 is placed in the mold 50 in the first step. The mold 50 includes a pin 52 inserted in a hole 51. In the first step, the pin 52 is positioned so as to protrude from the hole 51. The porous member 41 is placed in the mold 50 so as to be in contact with the pin 52.

The second step presses the porous member 41 with the mold 50. In the second step, the mold 50 presses the porous member 41 in the thickness direction so that the thickness of the porous member 41 is reduced from a first dimension W1 to a second dimension W2. The compression amount of the porous member 41 may be set based on the flow resistance of the porous member 41 after compression, for example.

The third step performs insert molding on the porous member 41 with the plastic 42A. As indicated by the arrow in FIG. 6, the plastic 42A is injected into the mold 50 from the right side in FIG. 6. In the step of injecting the plastic 42A, the pin 52 restricts movement of the porous member 41. When the mold 50 is filled with the plastic 42A, the pressure of the plastic 42A presses the pin 52 into the hole 51. After the insert molding, a trace 52A of the pin 52 may remain in the plastic member 42 (see FIG. 3). The hole 51 and the pin 52 may be omitted from the mold 50, provided that the porous member 41 can be placed in the mold 50 so as not to move relative to the mold 50 during insert molding.

Noise Reduction Effect of Porous Member

The noise reduction effect of the fan component 40 is obtained by arranging the porous member 41 so that the airflow KR passes through the pores of the porous member 41. When the pores of the porous member 41 are too small, or when the porosity of the porous member 41 is too low, the airflow KR cannot pass through the pores of the porous member 41, failing to provide sufficient noise reduction effect. When the pores of the porous member 41 are large, or when the porosity of the porous member 41 is high, the amount of the airflow KR passing through the pores of the porous member 41 increases. When a large amount of airflow KR passes through the pores of the porous member 41, the fan 30 may fail to achieve its original pressure increase effect. To ensure the original pressure increase effect of the fan 30 and to maintain the sufficient noise reduction effect, the flow resistance of the porous member 41 is set based on the pore diameter and porosity of the porous member 41.

Figure 7:
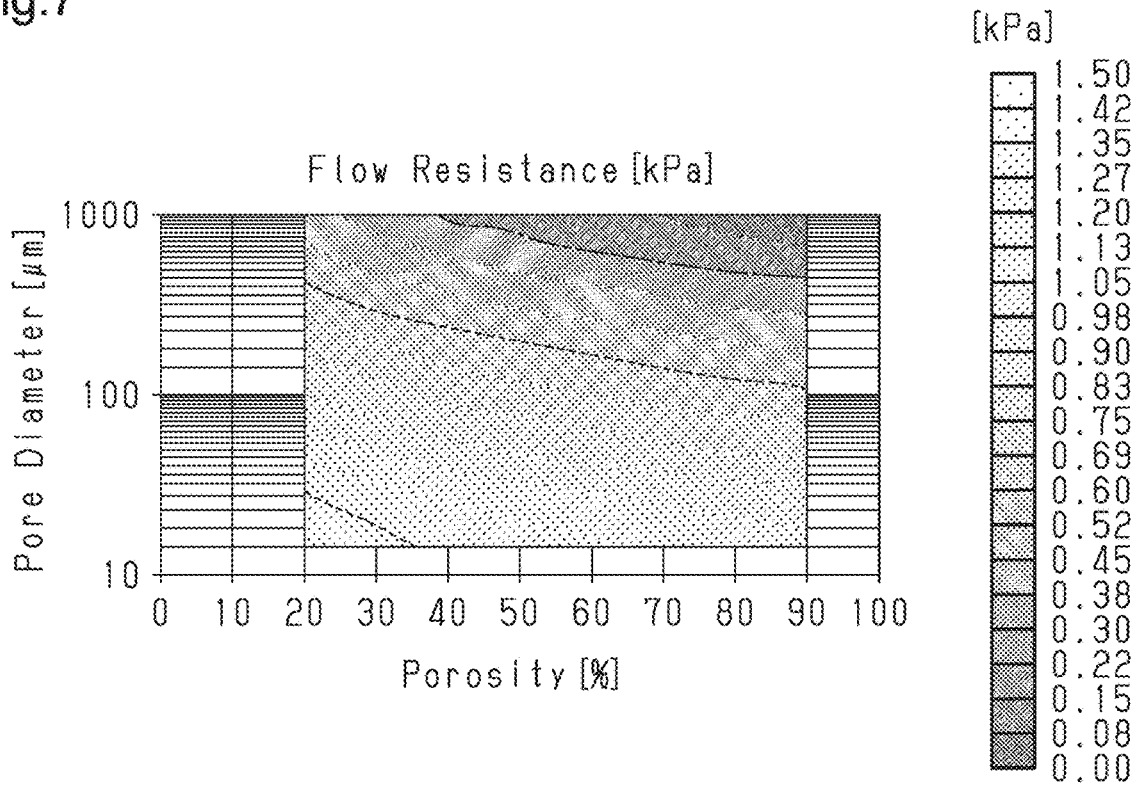
FIG. 7 is a diagram showing the relationship between porosity, pore diameter, and flow resistance of a porous member.

In FIG. 7, the flow resistance value of the porous member 41 is mapped with respect to the pore diameter and porosity of the porous member 41. In FIG. 7, the long-dash short-dash line indicates the line representing a flow resistance of 0.2 kPa. In the region in which the flow resistance of the porous member 41 is greater than or equal to 0.2 kPa, the plastic 42A does not easily flow into the porous member 41 during insert molding. The region in which the flow resistance of the porous member 41 is greater than or equal to 0.2 kPa not only hinders the flow of the plastic 42A into the porous member 41 during insert molding, but also achieves a desirable pressure increase effect of the fan 30.

Figure 8:
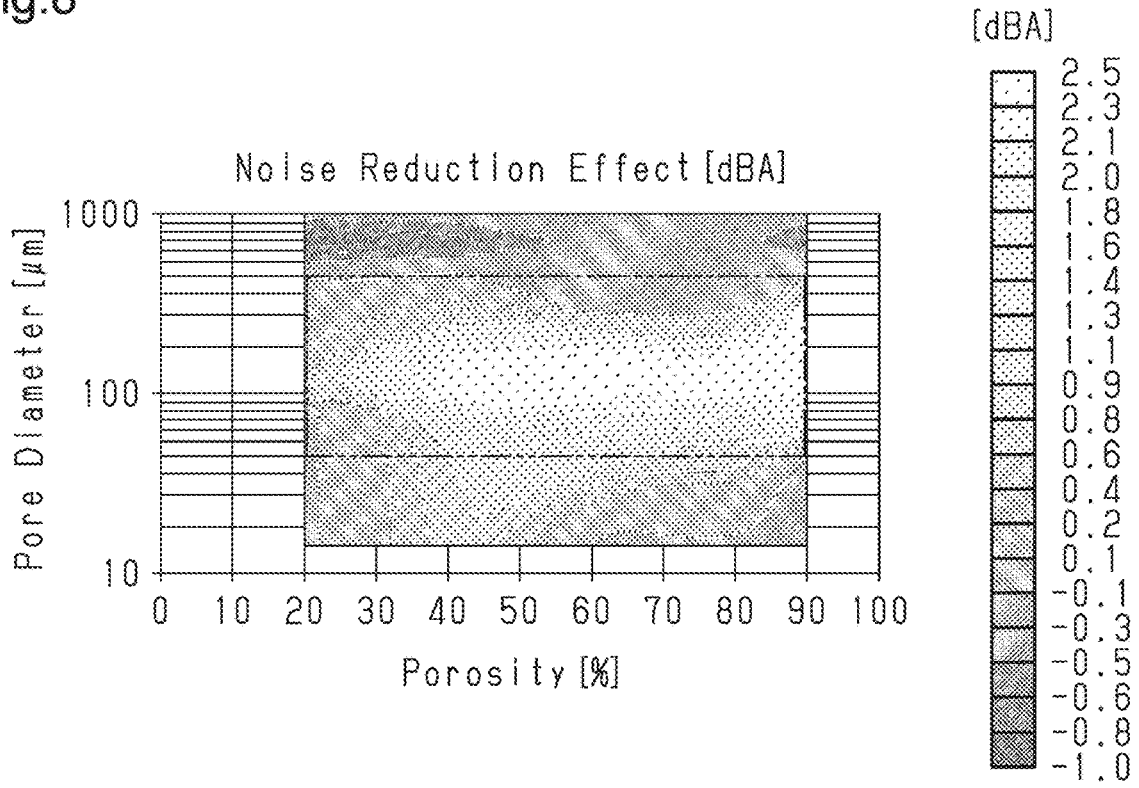
FIG. 8 is a diagram showing the relationship between porosity, pore diameter, and noise reduction effect of a porous member.

In FIG. 8, the value of the noise reduction effect of the porous member 41 is mapped with respect to the pore diameter and porosity of the porous member 41. The value of the noise reduction effect may be the sound pressure that the porous member 41 can reduce from the noise, for example. In the region in which the pore diameter of the porous member 41 is in a range of 50 μm to 500 μm and the porosity of the porous member 41 is in a range of 20% to 90%, the porous member 41 can maintain the noise reduction effect. The noise reduction effect is quantified as the noise level of a fan 30 with the porous member 41 with respect to the noise level of a fan 30 of the same shape but without the porous member 41.

In FIG. 8, the long-dash double-short-dash lines indicate the region in which the flow resistance is greater than or equal to 0.2 kPa, the pore diameter of the porous member 41 is in a range of 50 μm to 500 μm, and the porosity of the porous member 41 is in a range of 20% to 90%. In the region indicated by the long-dash double-short-dash lines, the noise reduction effect can be maintained, and the fan 30 can also achieve a sufficient pressure increase effect.

Figure 9:
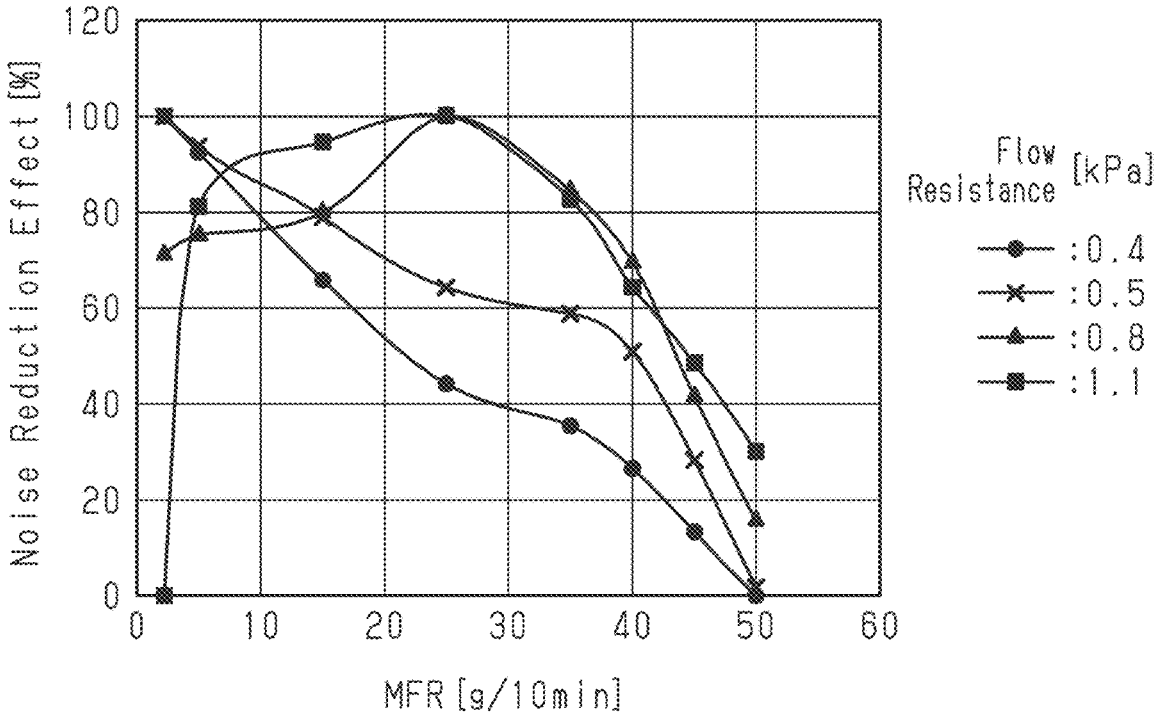
FIG. 9 is a diagram showing the noise reduction effect of each fan component with respect to the MFR of the plastic forming the plastic member, for each flow resistance of the porous member.

FIG. 9 shows the proportion of the noise reduction effect of the fan component 40 with respect to the MFR of the plastic 42A forming the plastic member 42 for each of the cases in which the flow resistance of porous member 41 is 0.4 kPa, 0.5 kPa, 0.8 kPa, or 1.1 kPa. To obtain the data of FIG. 9, multiple test fans 30 were prepared. Specifically, different test fans 30 were formed using fan components 40 that varied in the flow resistance of the porous member 41 and the MFR of the plastic 42A forming the plastic member 42. The test fans 30 had the same shape. The porous members 41 of the fan components 40 forming the test fans 30 were made of the same material but with different flow resistances. The plastic members 42 of the fan components 40 forming the test fans 30 were made of the same type of plastic 42A with different MFRs. The porous members 41 of the fan components 40 forming the test fans 30 were made of a glass fiber reinforced styrene acrylonitrile plastic (ASG) foam. The plastic members 42 of the fan components 40 forming the test fans 30 were made of glass fiber reinforced styrene acrylonitrile plastic (ASG). The data in FIG. 9 was obtained by measuring the noise generated by each of the test fans 30 as they rotate.

The proportion of noise reduction effect in FIG. 9 is the percentage of the value of noise reduction effect of each test fan 30 corresponding to values of MFR of the plastic 42A with respect to the maximum value of noise reduction effect of the test fan 30 in a situation where the flow resistance of the porous member 41 is a predetermined value. According to FIG. 9, with the porous member 41 having a flow resistance of 1.1 kPa, the maximum value of noise reduction effect is obtained when the MFR of the plastic 42A is 25 g/10 min. With the porous member 41 having a flow resistance of 1.1 kPa, the noise reduction effect of the fan 30 is about 80% or more of the maximum value of noise reduction effect when the MFR of the plastic 42A is 35 g/10 min.

The plastic 42A having a greater MFR is more likely to flow into the through-holes of the porous member 41 during insert molding. This tends to lower the noise reduction effect of the fan component 40. In the region in which the flow resistance of the porous member 41 is high and the MFR of the plastic 42A is low, it is difficult to form the fan 30. As such, the noise reduction effect of the fan component 40 may vary.

The fan component 40 achieves a noise reduction effect when the porous member 41 has a flow resistance in a range of 0.4 kPa to 0.8 kPa and the plastic 42A has an MFR in a range of 2 g/10 min to 45 g/10 min. Furthermore, the fan component 40 obtains a noise reduction effect of 20% or more of the maximum value of noise reduction effect when the flow resistance of the porous member 41 is in a range of 0.4 kPa to 1.1 kPa and the MFR of the plastic 42A is in a range of 5 g/10 min to 40 g/10 min. Preferably, when the flow resistance of the porous member 41 of the fan component 40 is in a range of 0.5 kPa to 1.1 kPa, and the MFR of the plastic 42A is in a range of 5 g/10 min to 40 g/10 min, a noise reduction effect of 30% or more of the maximum value of noise reduction effect can be obtained.

Operation of Embodiment

Operation of the present embodiment is now described.

In this embodiment, the fan component 40 includes the plastic member 42 made of the plastic 42A having an MFR in a range of 2 g/10 min to 45 g/10 min. The plastic 42A with an MFR less than or equal to 45 g/10 min does not easily flow into pores of the porous member 41 during insert molding using the plastic 42A.

In one example of the fan component 40 of this embodiment, the flow resistance of the porous member 41 is in a range of 0.5 kPa to 1.1 kPa. In FIG. 7, the broken lines indicate a flow resistance of 0.5 kPa and a flow resistance of 1.1 kPa. In FIG. 7, the region between the broken lines indicates the range in which the flow resistance is in a range of 0.5 kPa to 1.1 kPa. Since the flow resistance is less than or equal to 1.1 kPa, the plastic 42A flows into the porous member 41 during insert molding using the plastic 42A. As such, in the fan component 40, the porous member 41 and the plastic member 42 are appropriately bonded. At the same time, since the flow resistance is greater than or equal to 0.5 kPa, the porous structure of the porous member 41 is maintained during insert molding using the plastic 42A to the extent that the fan component 40 achieves a noise reduction effect by means of the porous structure.

The porous member 41 of this embodiment has a flow resistance with which the pore diameter of the porous member 41 is in a range of 50 μm to 500 μm and the porosity of the porous member 41 is in a range of 20% to 90%. Since the flow resistance of the porous member 41 is sufficiently high, the plastic 42A does not easily flow into the porous member 41. The fan component 40 not only maintains a sufficient noise reduction effect but also resists the flow of plastic 42A into the pores of the porous member 41 during insert molding.

The porous member 41 of the present embodiment includes the peripheral portion 44. During insert molding of the fan component 40, the plastic 42A first flows into the peripheral portion 44, and then flows toward the central portion 43 through the peripheral portion 44. In this embodiment, the peripheral portion 44 has the width D1, and the plastic 42A is therefore unlikely to flow into the central portion 43. The plastic 42A flows into the peripheral portion 44, forming the filled-pore portion 45 in the porous member 41. Since the plastic 42A flows into the pores in the filled-pore portion 45, the filled-pore portion 45 appropriately bonds the porous member 41 and the plastic member 42 together.

Advantages of Embodiment

The advantages of this embodiment are now described.

(1) The fan component 40 includes the porous member 41 and the plastic member 42. The MFR of the plastic 42A forming the plastic member 42 is in a range of 2 g/10 min to 45 g/10 min. Some of the pores of the porous member 41 are filled with the plastic 42A.

According to this configuration, since the MFR of the plastic 42A is less than or equal to 45 g/10 min, the number of pores in the porous member 41 filled with the plastic 42A is reduced. As a result, the porous member 41 and the plastic member 42 are integrally molded in a suitable manner while maintaining the noise reduction effect of the porous member 41.

When the plastic 42A has an MFR less than or equal to 45 g/10 min, the plastic 42A does not easily flow into the pores of the porous member 41 when the plastic member 42 and the porous member 41 are molded integrally. Since the plastic 42A does not easily flow into the pores of the porous member 41, the pores of the porous member 41 are more likely to be maintained.

When the MFR of the plastic 42A is greater than 45 g/10 min, the plastic 42A flows easily into the mold 50, and the injection time during insert molding can be shortened. However, when the MFR of the plastic 42A is too high, the plastic 42A flows not only into the peripheral portion 44 of the porous member 41 but also into the central portion 43 of the porous member 41 during insert molding. If the plastic 42A flows into the central portion 43 of the porous member 41, pores in the central portion 43 are filled with the plastic 42A, reducing the pores in the porous member 41. The reduced pores in the porous member 41 may lower the noise reduction effect of the porous member 41. The plastic 42A having an MFR less than or equal to 45 g/10 min is unlikely to permeate into the central portion 43 of the porous member 41 during insert molding.

The MFR of the plastic 42A may be in a range of 2 g/10 min to 40 g/10 min. According to this configuration, the plastic 42A does not easily flow into the pores of the porous member 41, so that the pores of the porous member 41 are more likely to be maintained.

The MFR of the plastic 42A may be in a range of 2 g/10 min to 35 g/10 min. According to this configuration, the plastic 42A does not easily flow into the pores of the porous member 41, so that the pores of the porous member 41 are more likely to be maintained.

The plastic 42A having an MFR of less than 2 g/10 min does not easily flow within the mold 50 during insert molding, making it difficult to form the fan component 40. It is difficult for the plastic 42A having an excessively low MFR to form the fan component 40 especially when the fan component 40 is thin. When the MFR of the plastic 42A is greater than or equal to 2 g/10 min, the plastic 42A flows suitably inside the mold 50 during insert molding, forming the fan component 40 in a suitable manner.

The MFR of the plastic 42A may be in a range of 5 g/10 min to 45 g/10 min. With this configuration, the plastic 42A more suitably flows within the mold 50 during insert molding, forming the fan component 40 in a more suitable manner.

Furthermore, with this configuration, of the pores of the porous member 41, the ones to be filled with the plastic 42A are appropriately set. Setting the MFR in this manner improves the bonding strength between the porous member 41 and the plastic member 42 while maintaining the noise reduction effect of the porous structure of the porous member 41.

(2) The MFR of the plastic 42A is in a range of 5 g/10 min to 40 g/10 min. According to this configuration, since the MFR of the plastic 42A is less than or equal to 40 g/10 min, the number of pores in the porous member 41 filled with the plastic 42A is reduced. When the MFR of plastic 42A is 5 g/10 min or more, the plastic 42A flows suitably within the mold 50 during insert molding, forming the fan component 40 in a more suitable manner.

(3) The MFR of the plastic 42A may be in a range of 5 g/10 min to 35 g/10 min. According to this configuration, since the MFR of the plastic 42A is less than or equal to 35 g/10 min, the number of pores in the porous member 41 filled with the plastic 42A is reduced. When the MFR of plastic 42A is 5 g/10 min or more, the plastic 42A flows suitably within the mold 50 during insert molding, forming the fan component 40 in a more suitable manner.

(4) The flow resistance of the porous member 41 is in a range of 0.5 kPa to 1.1 kPa. According to this configuration, since the flow resistance of the porous member 41 is greater than or equal to 0.5 kPa, the number of pores in the porous member 41 filled with the plastic 42A is reduced. At the same time, since the flow resistance of the porous member 41 is less than or equal to 1.1 kPa, pores of the porous member 41 are filled with the plastic 42A to an extent that integrates the porous member 41 and the plastic member 42. As such, since the flow resistance of the porous member 41 of the fan component 40 is in a range of 0.5 kPa to 1.1 kPa, the porous member 41 is molded integrally with the plastic member 42 while maintaining the noise reduction effect of the porous structure.

(5) The porosity of the porous member 41 is in a range of 20% to 90%, and the pore diameter of the porous member 41 is in a range of 50 μm to 500 μm. According to this configuration, since the porosity of the porous member 41 is in a range of 20% to 90%, and the pore diameter of the porous member 41 is in a range of 50 μm to 500 μm, the number of pores in the porous member 41 filled with the plastic 42A is reduced.

An increased flow resistance of the porous member 41 hinders the flow of the plastic 42A into the porous member 41. Since the flow of plastic 42A into the porous member 41 is hindered, the plastic 42A does not easily flow into the pores of the porous member 41. Since the porosity and pore diameter are reduced to increase the flow resistance of the porous member 41, the pores of the porous member 41 are more likely to be maintained when the porous member 41 and the plastic member 42 are integrally molded. The porous member 41 that has a porosity in a range of 20% to 90% and a pore diameter in a range of 50 μm to 500 μm maintains a noise reduction effect as well as a flow resistance that hinders the flow of the plastic 42A into pores of the porous member 41.

The porous member 41 that has a pore diameter of less than 50 μm results in a lower noise reduction effect. The porous member 41 that has a pore diameter of greater than 500 μm has a small flow resistance, facilitating the entry of the plastic 42A into pores of the porous member 41 during insert molding. The porous member 41 having a porosity of less than 20% results in a lower noise reduction effect. The porous member 41 that has a porosity of greater than 90% has a small flow resistance, facilitating the entry of the plastic 42A into pores of the porous member 41 during insert molding.

(6) The porosity of the porous member 41 is in a range of 30% to 90%, and the pore diameter of the porous member 41 is in a range of 90 μm and 300 μm. According to this configuration, the porosity of the porous member 41 is in a range of 30% to 90%, and the pore diameter of the porous member 41 is in a range of 90 μm to 300 μm, so that the number of pores in the porous member 41 filled with the plastic 42A is reduced.

(7) The porous member 41 includes the filled-pore portion 45. The pores in the filled-pore portion 45 of the porous member 41 are filled with the plastic 42A. According to this configuration, in the filled-pore portion 45, the pores of the porous member 41 are filled with the plastic 42A, so that the porous member 41 and the plastic member 42 are suitably bonded at the filled-pore portion 45.

(8) The porous member 41 includes the central portion 43 and the peripheral portion 44. The flow resistance of the peripheral portion 44 differs from the flow resistance of the central portion 43. According to this configuration, causing the central portion 43 and the peripheral portion 44 of the porous member 41 to have different flow resistances enables suitable management of the manner in which the porous member 41 and the plastic member 42 are bonded. In this embodiment, by causing the peripheral portion 44 to have a greater flow resistance than the central portion 43, it is possible to manage the porous member 41 and the plastic member 42 such that they are bonded only at the peripheral portion 44.

(9) The fan component 40 includes the porous member 41 and the plastic member 42 molded integrally with the porous member 41. The porosity of the porous member 41 may be in a range of 20% to 90%, and the pore diameter of the porous member 41 may be in a range of 50 μm to 500 μm. According to this configuration, since the porosity of the porous member 41 is in a range of 20% to 90% and the pore diameter of the porous member 41 is in a range of 50 μm to 500 μm, the number of the pores in the porous member 41 filled with the plastic 42A is reduced. As a result, the porous member 41 and the plastic member 42 are integrally molded in a suitable manner while maintaining the noise reduction effect of the porous member 41.

(10) The fan 30 is formed by the fan component 40. According to this configuration, the fan 30 that is formed by the fan component 40 is provided.

(11) The fan unit 20 includes the fan 30 and the bellmouth 21. According to this configuration, the fan unit 20 including the fan 30 and the bellmouth 21 is provided.

(12) The air conditioner 10A includes the fan unit 20. According to this configuration, the air conditioner 10A including the fan unit 20 is provided.

(13) The method for manufacturing the fan component 40 includes performing insert molding on the porous member 41 having multiple pores with the plastic 42A having an MFR in a range of 2 g/10 min to 45 g/10 min. According to this configuration, since the MFR of the plastic 42A is in a range of 2 g/10 min and 45 g/10 min, the plastic 42A does not easily flow into the pores of the porous member 41 when the porous member 41 undergoes insert molding. Since the plastic 42A does not easily flow into the pores of the porous member 41, the pores of the porous member 41 are more likely to be maintained. By using the plastic member 42 of such an MFR, the porous member 41 is subjected to insert molding in a suitable manner while maintaining the noise reduction effect of the porous member 41.

Modifications

In addition to the above-described embodiments, the air conditioner, the fan unit, the fan, the fan component, and the method for manufacturing a fan component of the present disclosure may be modified as modifications below or as combinations of at least two modifications that do not contradict each other.

The air conditioner 10A may be an air purifier. The fan unit 20 may form an air inlet or an air outlet of an air purifier. For example, an air purifier treats the intake air using a filter, a UV device, an ionizer device, a virus-removing spray device, a streamer device, or the like and then blows it out. The air purifier may be configured to treat the air in indoor spaces such as houses, offices, and the like. The air purifier may also be configured to treat air in an indoor space, such as a space in a warehouse where articles are stored, a work space where articles are handled, or the like.

The fan unit 20 may be provided in a heat pump device. The heat pump device of this modification includes a fan unit 20. The heat pump device may include a refrigerant circuit. The heat pump device may be an air conditioner or a water heater. According to this configuration, a heat pump device including the fan unit 20 is provided.

The member formed by the fan component 40 is not limited to the fan 30. The fan component 40 may form the bellmouth 21, and the fan component 40 may form the fan casing 23. When the fan component 40 forms the fan casing 23, the fan component 40 may form the air outlet 23A or the support portion 23B.

The predetermined conditions may be test conditions conforming to ISO 1133-1 or ISO 1133-2. The predetermined conditions may be test conditions conforming to JIS K7210-1, JIS K7210-2, or ASTM D1238.

In place of MFR, melt volume-flow rate (MVR) may be used. The MVR is the product of the melt mass flow rate of the plastic 42A and the melt density of the plastic 42A, for example.

The flow resistance of the peripheral portion 44 may be less than the flow resistance of the central portion 43. According to this configuration, the plastic 42A easily permeates the peripheral portion 44, thereby improving the bonding strength between the porous member 41 and the plastic member 42.

This specification discloses the following techniques.

(C1) A fan component (40) including a porous member (41) and a plastic member (42) molded integrally with the porous member (41), in which the porous member (41) includes a central portion (43) and a peripheral portion (44) located around the central portion (43). The peripheral portion (44) has a flow resistance that differs from a flow resistance of the central portion (43).

(C2) The fan component (40) according to (C1), in which the porous member (41) has a porosity in a range of 20% to 90%, and the porous member (41) has a pore diameter in a range of 50 μm to 500 μm.

The above describes embodiments and variations of a fan component, a fan, a fan unit, an air conditioner, a heat pump device, and a method for manufacturing a fan component. However, it will be understood that various changes in form and details are possible without departing from the spirit and scope of the fan component, fan, fan unit, air conditioner, heat pump device, and method for manufacturing a fan component described in the claims.

The invention claimed is:

1. A fan component, comprising:

a porous member having multiple pores, the porous member having a flow resistance in a range of 0.5 kPa to 1.1 kPa; and a plastic member molded integrally with the porous member, a plastic forming the plastic member having a melt flow rate (MFR) in a range of 2 g/10 min to 45 g/10 min, and some of the pores being filled with the plastic.

2. The fan component according to claim 1, wherein the melt flow rate (MFR) of the plastic is in a range of 5 g/10 min to 40 g/10 min.

3. The fan component according to claim 2, wherein the melt flow rate (MFR) of the plastic is in a range of 5 g/10 min to 35 g/10 min.

4. The fan component according to claim 1, wherein the porous member has a porosity in a range of 20% to 90%, and the porous member has a pore diameter in a range of 50 μm to 500 μm.

5. The fan component according to claim 4, wherein the porosity of the porous member is in a range of 30% to 90%, and the pore diameter of the porous member is in a range of 90 μm to 300 μm.

6. The fan component according to claim 1, wherein the porous member includes a filled-pore portion, and the pores in the filled-pore portion of the porous member are filled with the plastic.

7. The fan component according to claim 1, wherein the porous member includes a central portion and a peripheral portion located around the central portion, and the peripheral portion has a flow resistance that differs from a flow resistance of the central portion.

8. A fan including the fan component according to claim 1.

9. A fan unit including the fan according to claim 8, the fan unit further comprising:

a bellmouth.

10. An air conditioner including the fan unit according to claim 9.

11. A heat pump device including the fan unit according to claim 9.

12. A fan component, comprising:

a porous member; and a plastic member molded integrally with the porous member, the porous member having a porosity in a range of 20% to 90%, and the porous member having a pore diameter in a range of 50 μm to 500 μm, the porous member including a central portion and a peripheral portion located around the central portion, and the peripheral portion having a flow resistance that is greater than a flow resistance of the central portion.

13. A method for manufacturing a fan component including a porous member having multiple pores and a plastic member molded integrally with the porous member, the method comprising:

forming the porous member to have a flow resistance in a range of 0.5 kPa to 1.1 kPa; and molding the plastic member integrally with the porous member by performing insert molding on the porous member with a plastic having a melt flow rate (MFR) in a range of 2 g/10 min to 45 g/10 min.

* * * * *